US005575400A

United States Patent [19]

Turner et al.

[11] Patent Number: 5,575,400

[45] Date of Patent: Nov. 19, 1996

[54] CONTAINERS

[75] Inventors: Terence A. Turner, Frilford Heath; Stuart A. Monro, Witney; Simon P. Rose, Swindon; Mary A. Parker, Wotton-under-Edge; Gordon Rothwell, Wantage, all of United Kingdom

[73] Assignee: CarnaudMetalbox plc, United Kingdom

[21] Appl. No.: 806,741

[22] Filed: Dec. 13, 1991

[30] Foreign Application Priority Data

Dec. 22, 1990 [GB] United Kingdom ..... 9027954

[51] Int. Cl.[6] ..... B65D 7/42

[52] U.S. Cl. ..... 220/458; 220/604

[58] Field of Search ..... 220/458, 457, 220/604, 605, 606, 608

[56] References Cited

U.S. PATENT DOCUMENTS

| | | | |
|---|---|---|---|
| 3,360,157 | 12/1967 | Bolt et al. . | |
| 3,655,349 | 4/1972 | Shah et al. . | |
| 3,738,528 | 6/1973 | Kagami | 220/604 |
| 4,049,842 | 9/1977 | Gerek et al. . | |
| 4,054,227 | 10/1977 | Saunders . | |
| 4,055,272 | 10/1977 | Beese . | |
| 4,405,058 | 9/1983 | Phalin | 220/458 |
| 4,452,375 | 6/1984 | Marcus | 220/458 |

FOREIGN PATENT DOCUMENTS

| | | |
|---|---|---|
| 0199487 | 10/1986 | European Pat. Off. . |
| 0352711 | 1/1990 | European Pat. Off. . |
| 0371397 | 6/1990 | European Pat. Off. . |
| 0447563 | 9/1991 | European Pat. Off. . |
| 56-53506 | 12/1981 | Japan . |
| 1575204 | 3/1977 | United Kingdom . |
| 2051646 | 1/1981 | United Kingdom . |
| 2089248 | 6/1982 | United Kingdom . |

OTHER PUBLICATIONS

EP Standard Search Report of Jun. 8, 1991 Examiner's Report to the Comptroller dated 8 Mar. 1991.

*Primary Examiner*—Steven M. Pollard
*Attorney, Agent, or Firm*—Diller, Ramik & Wight, PC

[57] ABSTRACT

A can body (40) drawn from a tinplate to comprise an end wall (41) and an integral side wall (42) which extends from the periphery of the end wall to a terminal portion defining a mouth, has a margin (48) of coating material, such as expoxy phenolic lacquer, applied only to an upper portion of the interior surface of the side wall (42) leaving the interior tin surface of the rest of the side wall and end wall (41) exposed. The side wall may be wall ironed from selected grade of tinplate. The advantages arising are protection of cold worked side wall material and control of the ammount of tin available to be picked up by a product in the can.

Various methods are described for making the cans such as deep drawing and alternatively wall ironing.

15 Claims, 13 Drawing Sheets

COMPARISON OF THE INTERNAL WALL ROUGHNESSES OF CANS PRODUCED BY THE DRD AND PWI PROCESSES

ORIGINAL UNDEFORMED PLATE.

211 × 400 D.R.D. CAN WALL

P.W.I. CAN WALL

SAMPLE: GRAIN COUNT – 2800 GRAINS/$mm^2$.
TRACE MAGNIFICATIONS.
HORIZONTAL 100×
VERTICAL 2000×

COMPARISON OF THE INTERNAL WALL ROUGHNESSES OF CANS PRODUCED BY THE DRD AND P.W.I. PROCESSES

ORIGINAL UNDEFORMED PLATE.

211×400 DRD CAN WALL

P.W.I. CAN WALL

SAMPLE : GRAIN COUNT ~ 40 TO 50 × $10^3$ GRAINS/$mm^2$

TRACE MAGNIFICATIONS

HORIZONTAL 100×
VERTICAL 2000×

Fig. 8a. PASTA IN TOMATO SAUCE - AMBIENT.
T2BA, 35M, 13·8g/m², ET + LAC. ENDS.
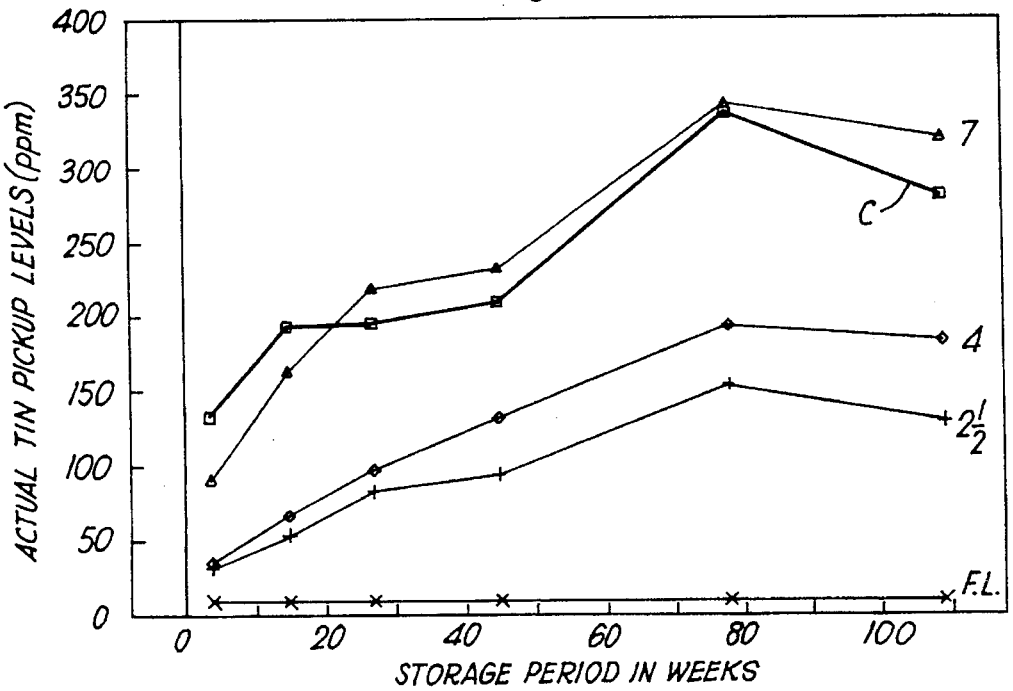
□ 3-Piece control. + 2·5cm Beaded nonchr. ◇ 4cm Beaded nonchrom.
△ 7cm Beaded nonchrom. × Fully lacquered.
Fig. 8b. PASTA IN TOMATO SAUCE - AMBIENT.
T2BA, 35M, 13·8g/m², ET + LAC. ENDS.
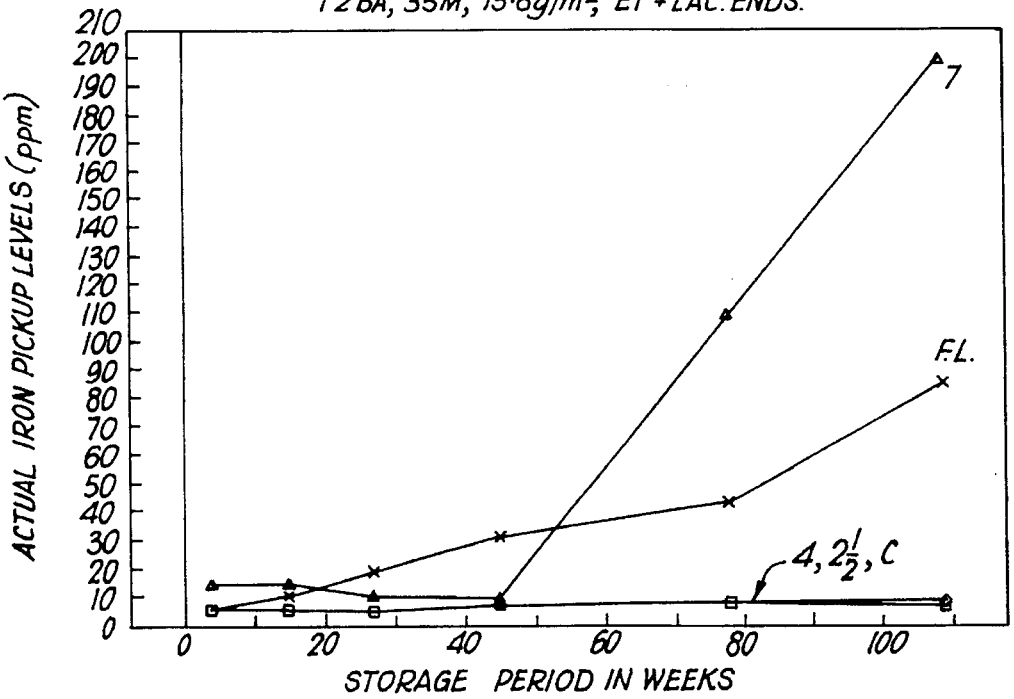
□ 3-Piece control. + 2·5cm Beaded nonchrom. ◇ 4cm Beaded nonchrom.
△ 7cm Beaded nonchrom. × Fully lacquered.

Fig. 9a. PASTA IN TOMATO SAUCE - AMBIENT.
T2BA, 35M, 13·8g/m², ET + LAC. ENDS
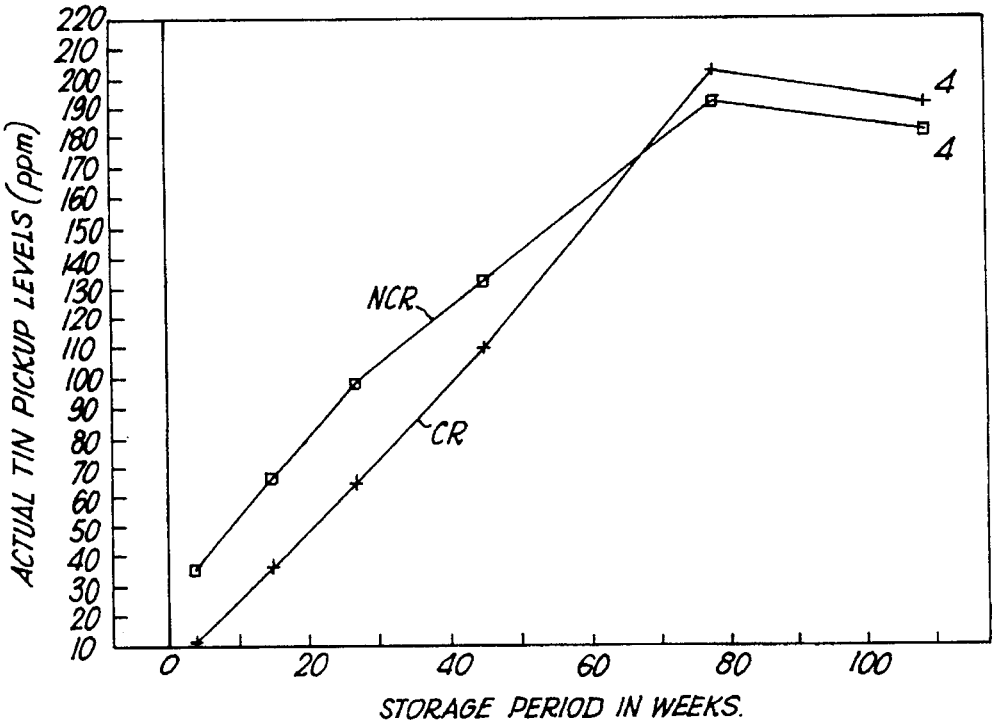
□ 4 cm exp. non-chr. + 4cm exp. chromated.
Fig. 9b. PASTA IN TOMATO SAUCE - AMBIENT.
T2BA, 35M, 13·8g/m², ET + LAC. ENDS.
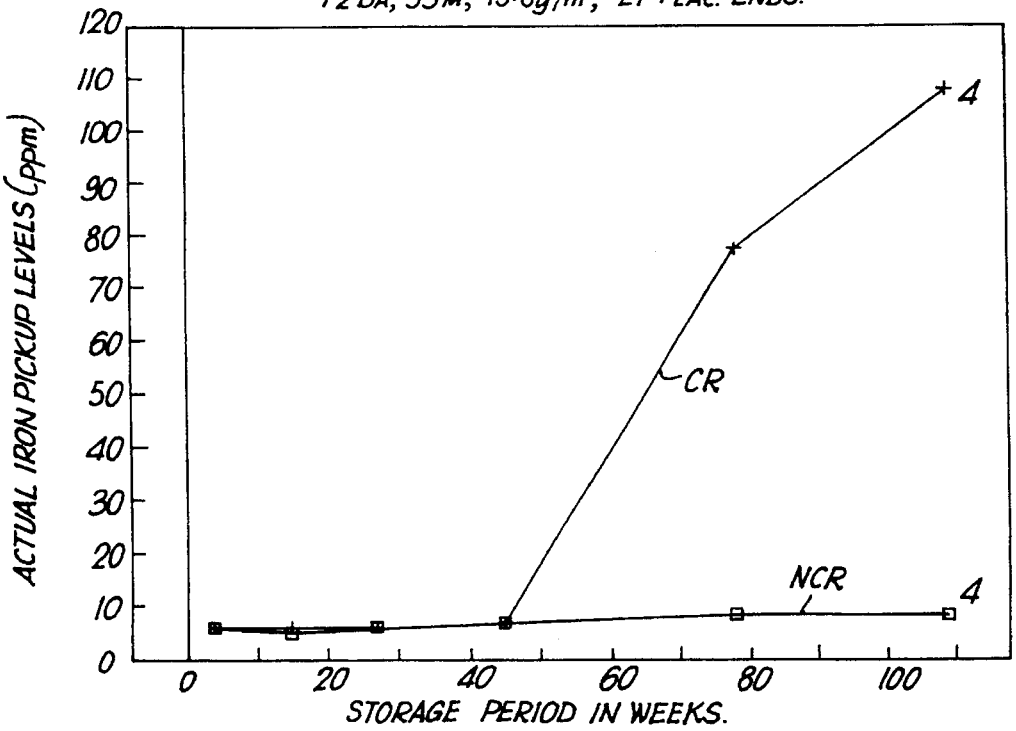
□ 4cm exp. non-chrom. + 4cm exp. chromated.

Fig. 10a. SPAGHETTI HOOPS IN TOMATO SAUCE. AMBIENT
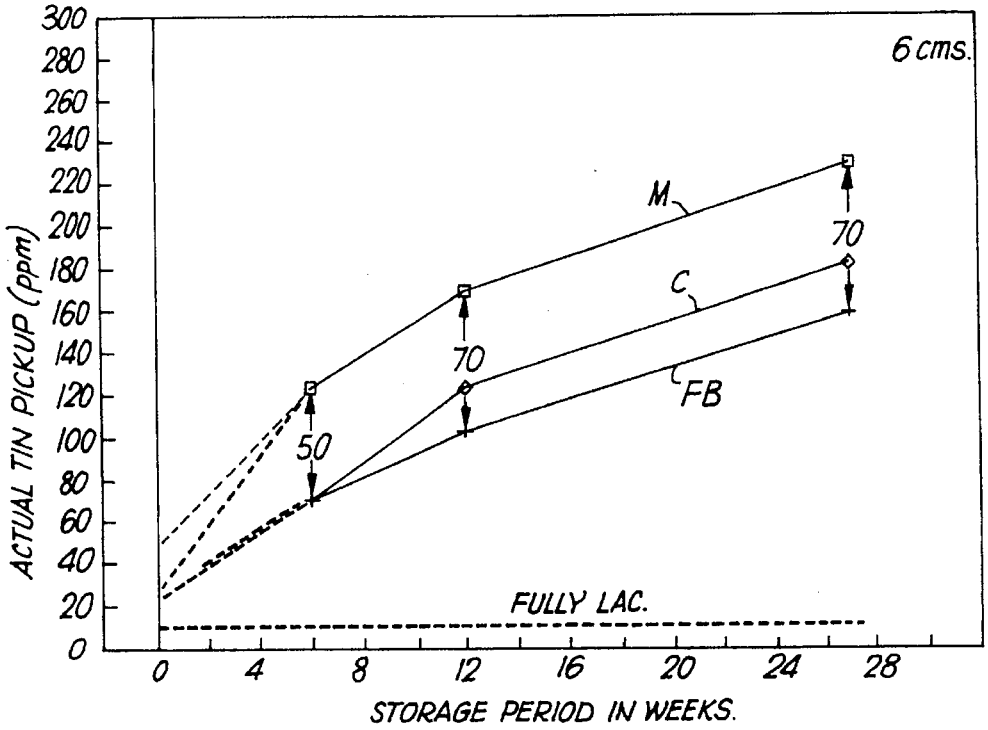
□ 2-Piece matt. + 2-Piece bright ◇ 3-Piece control.
Fig. 10b. SPAGHETTI HOOPS IN TOMATO SAUCE ELEVATED (37C)
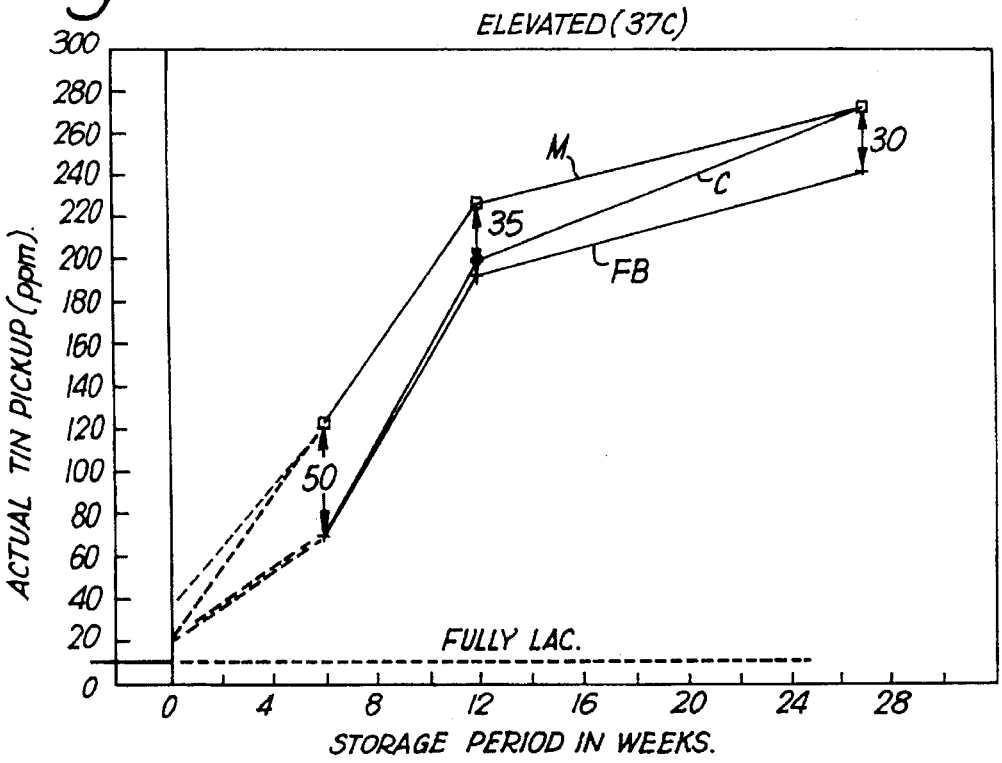
□ 2-Piece matt. + 2-Piece bright. ◇ 3-Piece control.

Fig. 11a. BB's IN TOMATO SAUCE - AMBIENT.
T4CA, 35M 12g/m², ET + PLAIN ENDS.
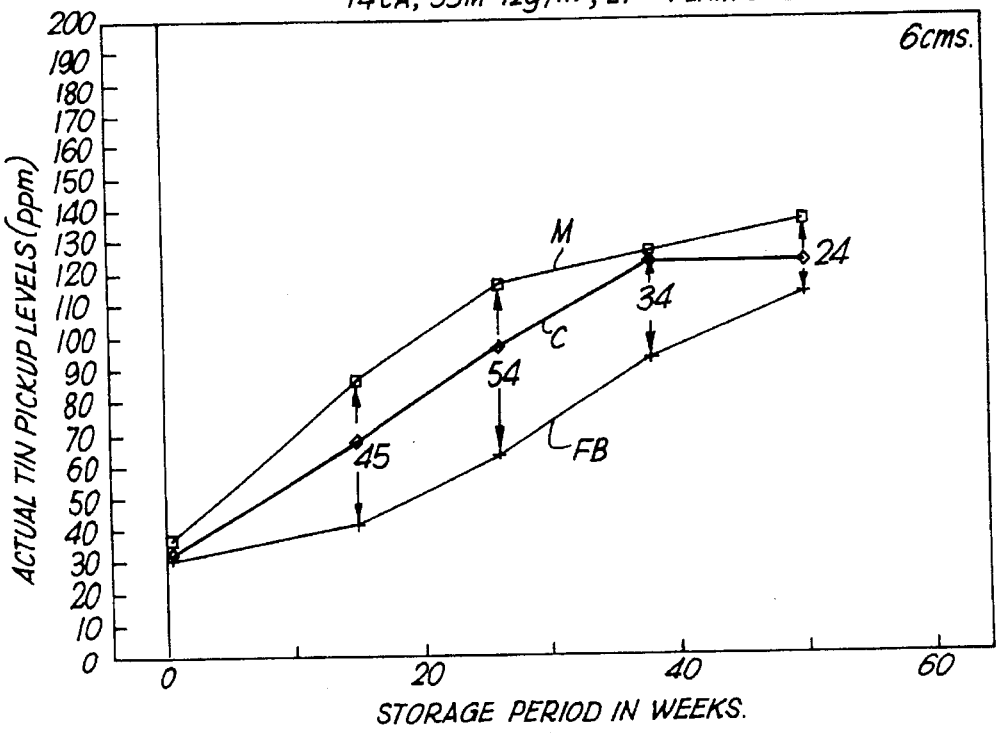
□ T4CA Matt finish. + T4CA Bright finish. ◇ 3-Piece control.
Fig. 11b. BB's IN TOMATO SAUCE - AMBIENT
T4CA, 35M, 12g/m², ET + PLAIN ENDS
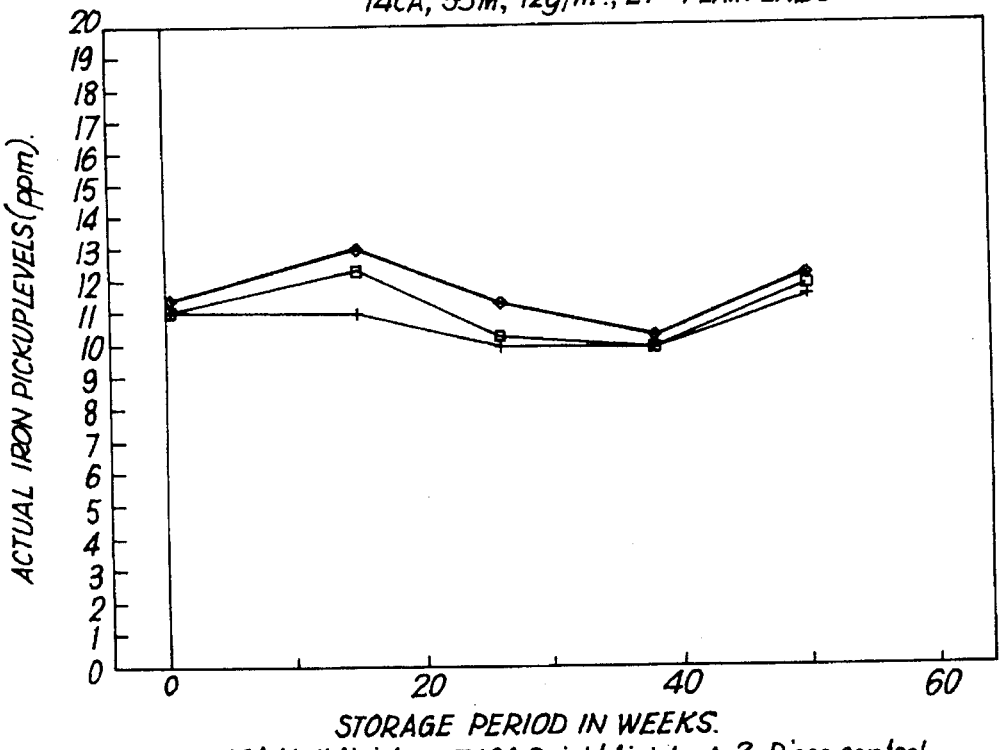
□ T4CA Matt finish. + T4CA Bright finish ◇ 3-Piece control.

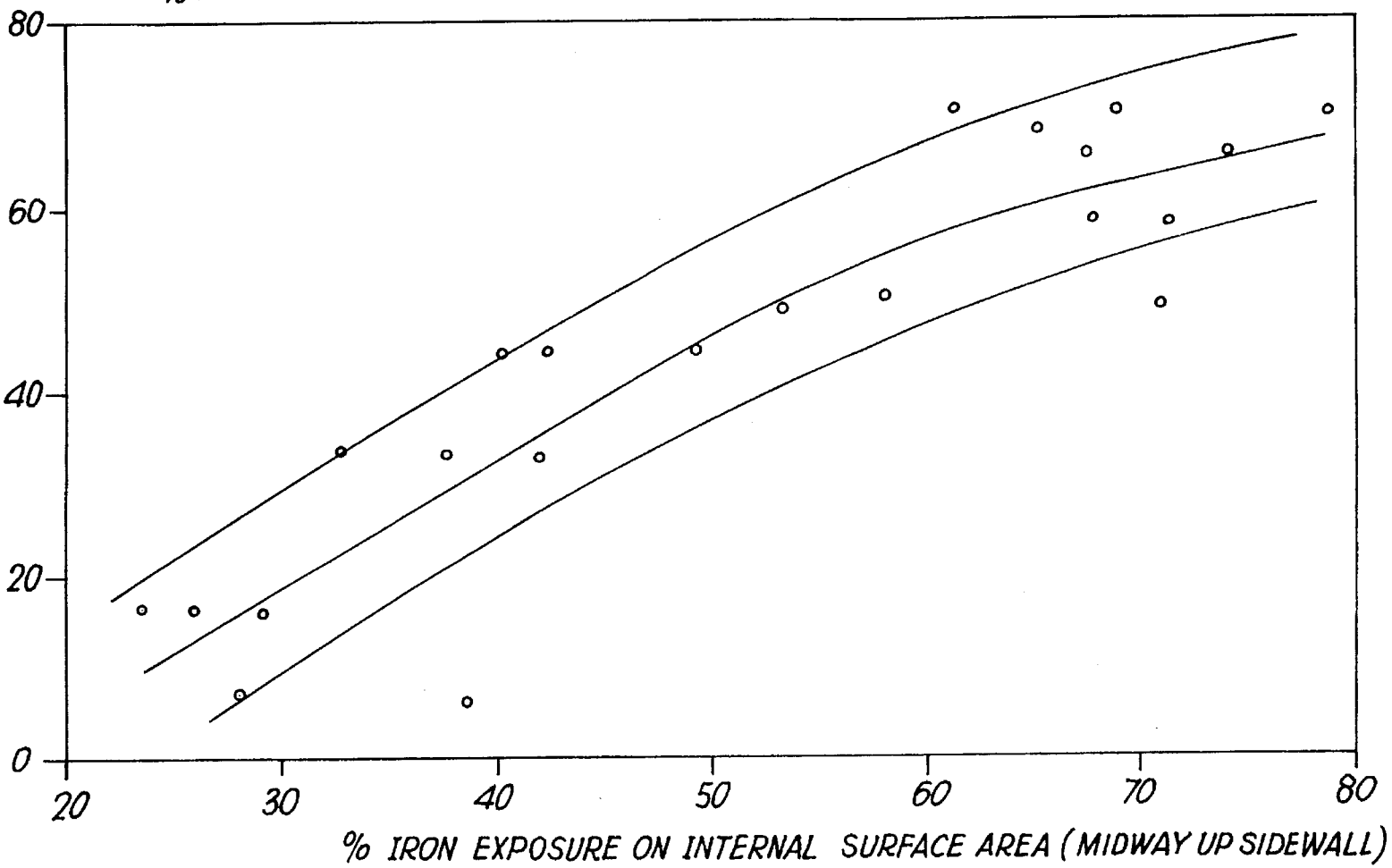
Fig. 12. % IRONING REDUCTION VERSUS % IRON EXPOSURE ON THE INTERNAL SURFACE AREA OF TINPLATE D.W.I. CANS.
USI.3 BATCH. NORMAL 'LOW' D 2·24/3·36 TINCOATING.
% IRONING REDUCTION.

SPAGHETTI HOOPS IN TOMATO SAUCE — AMBIENT
T4 CA 35B D15/2·8 CAN SIZE LIT. I LACQUERED END
TIN PICK-UP (ppm)
STORAGE PERIOD IN WEEKS
□ 4cm EXPOSED
+ 5cm EXPOSED
◇ 6cm EXPOSED
× 8cm EXPOSED
△ 7cm EXPOSED
R8
R7
R6
R5
R4
8
7
6
5
4
0
4
8
12
16
20
24
40
50
60
70
80
90
100
110
120
130
140
150
160
170
180
190
200
210

CONTAINERS

BACKGROUND OF THE INVENTION

This invention relates to a can body drawn from a tinplate and a method of making the can body.

For many years white fruits and products containing tomato or tomato sauce have been packed in cans made from uncoated tinplate. The cans have a body comprising a cylindrical side wall which includes a longitudinal side seam and can end (called the makers end) attached to one end of the side wall by a double seam, the combination of side wall and end wall being called an open top can. The open top can is filled with product, closed by double seaming a second can end (called the packer's end) onto the other end of the side wall, and thermally processed to sterilise the contents. During thermal processing and subsequent storage the product takes up a certain amount of the tincoating so preserving the organoleptic and visual properties of the product by minimizing oxidation of the product.

Japanese Patent Publication Laid Open No 52-37170 discusses attempts to locally lacquer the interior of tin plate can bodies to achieve a controlled area of tin available to the product and observes that this arrangement is not satisfactory. The specification describes can bodies made from tin free steel sheet laminated to a film of polymeric material which has a band of vapour deposited tin on the film so that the interior surface of the can body presents a controlled amount of tin (the vapour deposited band) to the product whilst the rest of the internal surface of the can body is protected by polymeric film. Whilst this prior art can achieves control of the amount of tin presented to the product the cans are expensive to make because they require vapour deposition of tin on a film and lamination of the film to a tinplate before manufacture of the can body comprising a tubular side wall closed at both ends by an end wall fixed by a double seam.

SUMMARY OF THE INVENTION

Objectives of the present invention include 1) provision of a can body having a controlled amount of tin available to a product packed therein.
2) avoidance of the expense of vapour deposition and laminated polymeric film.
3) an economical mass production method to achieve a can body giving a reliable rate of tin transfer into the product.
4) avoidance of the side seam and one double seam associated with the traditional can body.

Accordingly in a first aspect this invention provides a can body drawn from a tinplate to comprise an end wall and an integral side wall which extends from the periphery of the end wall to a terminal portion defining a mouth of the body, characterized in that, a margin of organic coating material, such as a lacquer or coating, extends from the terminal portion along the interior surface of the side wall for an axial distance less than the length of the side wall, and the rest of the side wall has an exposed tin surface.

The benefits arising from this container body are a seamless body that can be relied upon not to leak, and that presents a calculated amount of tin to the product.

The organic coating material maybe chosen from a group consisting of epoxy phenolic lacquer, epoxy amine lacquer, acrylic resin lacquer, epoxy polyester lacquer, and vinyl lacquer with or without a pigment.

However, several problems arise from the deformation occuring during deep drawing and/or wall ironing of can bodies. Whilst a can may be drawn from a precoated tinplate blank, the incorrect choice of too large a grain size of the steel substrate of the tinplate will give rise, during drawing, to surface disturbance called the "orange peel effect" at risk of disruption of a preapplied coating or lacquer to expose the metal substrate of the blank. Typically a can drawn in a single drawing operation would be made from a tinplate having a grain size finer than 3000 grains/mm$^2$, a surface roughness between 12 and 25 micro inch CLA, and a weight of tin in a range between 3 to 10 grams/mm$^2$. A differentially coated tinplate may be used if desired preferably with the heavier tin weight inside the can.

Deeper drawn articles made by redrawing a shallow uncoated cup may suffer extensive unacceptable localised redistribution of the tincoating. Severe wall ironing reductions of side wall thickness thin the tin at risk of exposing tin iron alloy present on flow brightened tinplates, on steel of a non-flow-brightened tinplate.

In a second embodiment of the drawn can the side wall has been passed through at least two drawing dies, and the tinplate from which the can was drawn had a grain size finer than 4000 grains per square millimetre, a surface roughness between 12 and 25 microinches CLA, and an initial tin weight greater than 5.6 grams/mm$^2$ that becomes the interior surface of the can body. The last die may, if desired, be of a shape to impose an ironing reduction of the order of 10% so the side wall becomes thinner than the end wall. The organic coating is chosen from epoxy phenolic lacquer or epoxy based lacquer.

In a third embodiment of the drawn can the side wall has been passed through at least two drawing dies and at least one wall ironing die so that the side wall is thinner than the end wall, and the tinplate from which the can was drawn had a grain size finer than 20,000 grains/mm$^2$, and a weight of tin greater than 10 grams/m$^2$. Preferably, the organic coating on these wall ironed cans is an epoxy phenolic lacquer.

In a second aspect this invention provides a method of making a drawn can body from tinplate by the steps of:

a) cutting a blank from a sheet of tinplate;

d) drawing the blank to a cup having an end wall and an integral side wall extending from the periphery of the end wall and an integral side wall extending from the periphery of the end wall to a terminal portion defining a mouth of the can body, characterized in that, c) an organic coating is applied to a margin of the interior surface of the side wall to extend from the terminal portion along the interior surface of the side wall for a distance less than the length of the side wall, and the rest of the side wall and the end wall have exposed tin surfaces.

The organic coating material may be applied as an annulus to the sheet of tinplate before cutting the blank in step (a). Alternatively the organic coating material may be applied as a spray delivered from a nozzle and directed onto the side wall made in step (b).

Preferably the organic coating material is chosen from epoxy phenolic lacquer, epoxy amine lacquer, acrylic lacquer, epoxy ester lacquer, or vinyl lacquer. When drawing a can body in a single die or redrawing in a second die from prelacquered tinplate it is preferable that the tinplate has a grain size finer than 3000 grains/mm$^2$. It is also desirable that the tinplate has a surface roughness between 12 microinches CLA and 25 microinches CLA. In order that sufficient tin is available to confer organoleptic advantage it is preferable that the tinplate has a weight of tin coating greater than 5.6 grams/m$^2$.

In an alternative redrawing method, after step (b), the drawn can body is mounted on a punch and pushed through a redrawing die which makes with the punch a clearance smaller than the thickness of the tin plate so that the side wall of the drawn cup is reduced in diameter and thickness, and the side wall length is increased. It is convenient to apply coating material as a spray from a nozzle directed onto the redrawn side wall as the can body is rotated. An epoxy phenolic lacquer or epoxy based lacquer may be used. Similar tinplates may be used for redrawn cans as are used for drawn cans, but with a final grain size finer than 4000 grains/mm$^2$. More tin weight may be needed if the sidewall is ironed.

In an alternative method the drawn can body is redrawn to a reduced diameter and increased side wall height of substantially equal thickness to that of the end wall, and thereafter the redrawn side wall is passed through at least one ironing ring to thin and elongate the side wall while the end wall thickness remains substantially unaltered.

Preferably the coating material is applied as a spray from a nozzle directed onto the ironed side wall while the can body is rotated. A suitable coating material is an epoxy phenolic lacquer which is stoved at 200° C. for 2 minutes.

Preferably the tinplate for this ironed can body has a grain size finer than 20,000 grains/mm$^2$, a surface roughness of the order of 35 microinches CLA, and a weight of tin coating between 10 and 15 grams/m$^2$. If desired the tinplate is a differentially coated tinplate such as D2.8/15, and the heavier 15 gram/m$^2$ coating is on the interior surface of the finished can.

It is possible to estimate the tin coating weight required by means of the formula:

$$T = \frac{CV}{\pi R(2H + R)(1 - I/100)}$$

and the height H of bare tin the side wall is expressed:

$$H = \frac{1}{2}\left\{ \frac{CV}{\pi RT(1 - I/100)} - R \right\}$$

where

T=the tin coating in grams/m$^2$ of the as received tinplate;

I=the ironing reduction employed (%);

V=the weight in grams of product in the can whose diameter is 2 R;

H=the extent (height in mm) of the bare tin margin;

C=the chosen level in ppm of tin pickup.

The invention is particularly useful for the packing and storage of tomato based products.

BRIEF DESCRIPTION OF DRAWINGS

Various embodiments will now be described by way of example and with reference to the accompanying drawings in which:

FIG. 8*a* is graphs of actual tin content of pasta in tomato sauce plotted against time of storage at ambient temperature in drawn and ironed containers having a range of heights of exposed tin on the side wall, plotted against fully laquered control cans made by double seaming.

FIG. 8*b* a like graph to FIG. 8*a* on increased scale showing iron pickup levels v time.

FIG. 9*a* is a graph of actual tin content of pasta in tomato sauce plotted against time of storage at ambient temperature in chromate washed and nonchromate washed drawn and ironed cans plotted against control cans made by double seaming.

FIG. 9*b* is a like graph to FIG. 9*a* on an increased scale showing iron pickup levels against time for chromate washed and non-chromate washed cans.

FIG. 10*a* is a graph of actual tin content of spaghetti hoops in tomato sauce plotted against time of storage at ambient temperature in cans drawn and ironed from matt and flow brightened tinplate relative to a control cans made by double seaming.

FIG. 10*b* is a like graph to FIG. 10*a* arising from storage at 37° C.

FIG. 11*a* is a graph of actual tin content in baked beans in tomato sauce plotted against time of storage at ambient temperature in drawn and ironed cans made from matt tinplate, flow brightened tinplate, relative to control cans;

FIG. 11*b* is a like graph on enlarged scale showing iron pickup levels against time;

FIG. 12 is a graph of iron exposure against % wall ironing reduction; and

DESCRIPTION OF THE PREFERRED EMBODIMENTS

In order to manufacture cans according to this invention it is necessary to:

(A) select appropriate tinplate to permit deep drawing to a hollow article but which minimises roughening of the cup wall;

(B) select appropriate lacquers or coatings that will adhere to the drawn side wall surface of cans produced;

(C) select a manufacturing procedure appropriate to the size of can produced; and (D) to perform tests to make sure the cans actually release appropriate amount of tin into product packed in the can.

These matters are discussed in this order with reference to the drawings:

(A) SELECTION OF TINPLATE

Figure 1A:
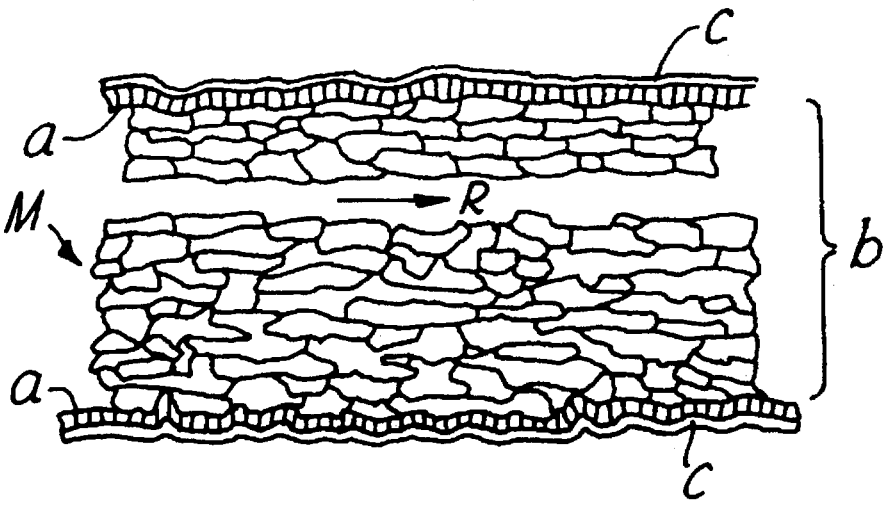
FIG. 1*a* is a sectioned side view of a fragment of matt tinplate.

FIG. 1*a* shows diagramatically a section through a matt tinplate M, so called because the tin layer (a) is in the as electroplated condition on the rolled steel (b) matrix. In FIG. 1*a* the steel matrix comprises elongated grains extending in a direction left to right called the rolling direction "R".

Figure 2:
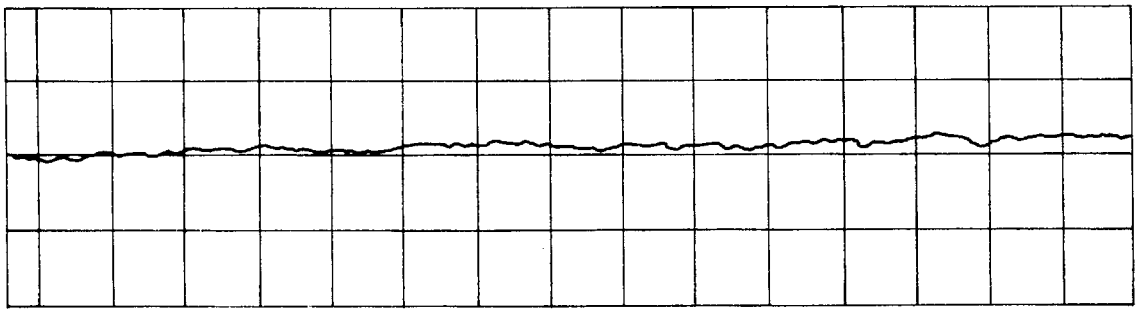
FIG. 2*a* is a surface roughness trace of the large grain size tinplate of FIG. 1*a;*
FIG. 2*b* is a surface roughness trace of the tinplate of FIG. 1*a* after drawing and redrawing to become a side wall of a can.
FIG. 2*c* is a surface roughness trace of the tinplate of FIG. 1*a* after drawing and redrawing through a punch/die gap to achieve. a small degree of ironing reduction in wall thickness.
Figure 2:
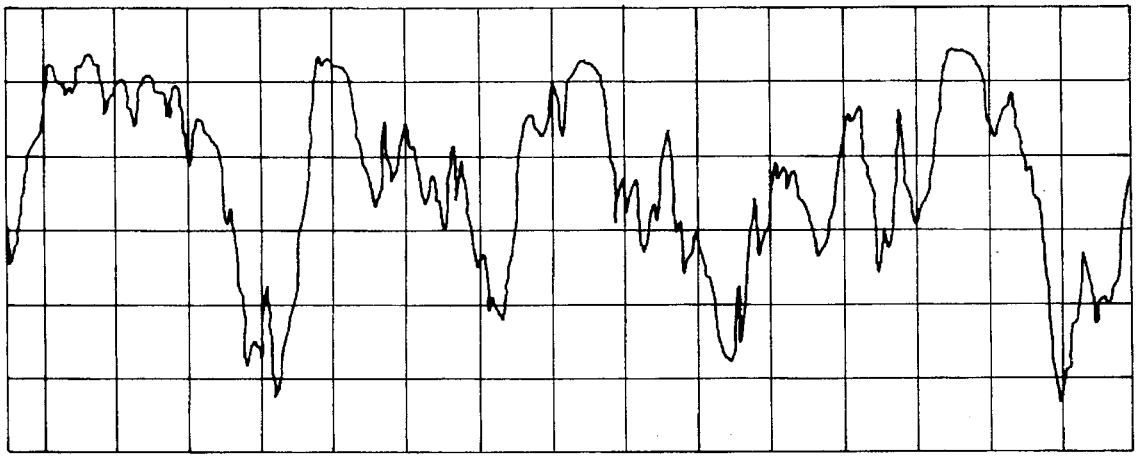
Figure 2:
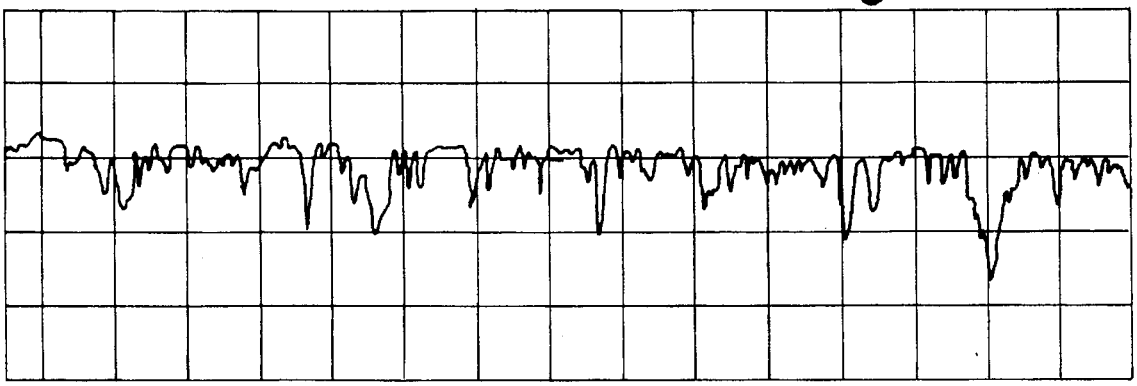

The surface of the steel matrix is not smooth because the mill rolls impose their surface finish on the steel as shown in FIG. 2*a*. A range of surface roughness is available from the rolling mills ranging typically from 8 microinch CLA to 100 microinch CLA.

In FIG. 1*a* the tin layer "a" can be seen to approximately follow the steel surface. A thin oxide layer "c" will develop on the tin layer and the mills usually cover this with a protective film such as dioctyl sebacate (not shown in FIG. 1) before sale.

FIG. 1 shows a tinplate characterized by the following parameters:

Grain size 2500–3500 grains/square mm

Surface roughness 35 microinch CLA

Tensile strength 320–380 N/mm$^2$

Tin weight 10–15 g/m$^2$

Steel of this type is used to make cans by blanking a disc, drawing a cup from the disc, redrawing the drawn cup, and then wall ironing the redrawn cup. The surface roughness of 35 microinch is chosen to provide surface contours to hold lubricant and the plate thickness and tin weight are chosen so that after an appropriate wall ironing reduction a tin coating of at least about 6 grams/m$^2$ will remain on the side wall. FIG. 2*c* shows the roughness of the side wall after partial or slight wall ironing: the flattened peaks, created by ironing, are clearly visible and illustrate the risk of iron exposure.

Figure 1B:
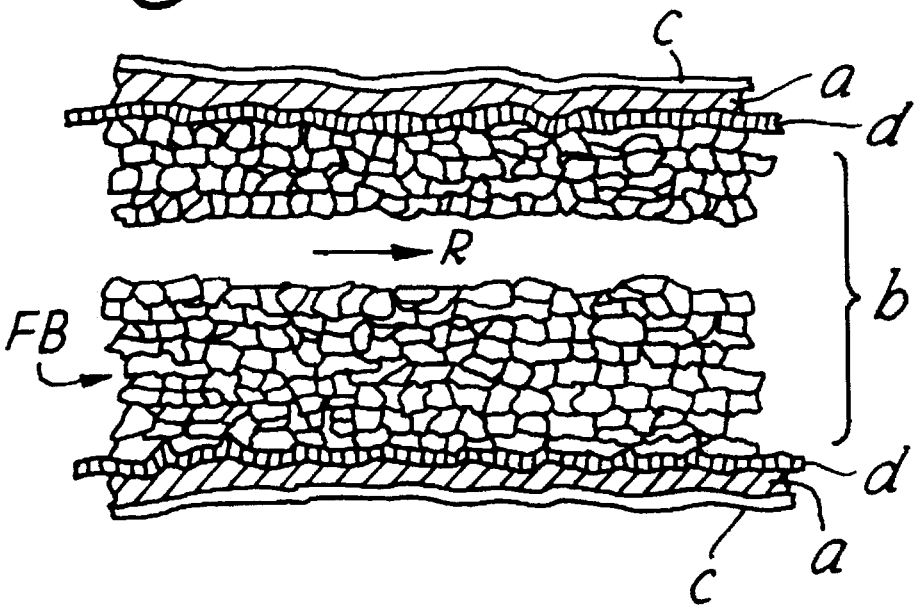
FIG. 1*b* is a sectioned side view of a fragment of flow brightened tinplate.

FIG. 1*b* shows diagramatically a section through a flow brightened tinplate (FB), so called because the electro plated tin layer has been melted to create a visually bright finish on the outer layer of tin. A layer of an intermetallic compound (d) of tin and iron joins the outer tin layer to the rolled steel inside. As in FIG. 1*a*, an oxide layer covers the exterior surface of the tin layer. This thin oxide layer may be modified by a passivation treatment such as a chromate treatment.

As depicted in FIG. 1*b* the parameters characterising this flow brightened tinplate are:

Grain size: 40,000–50,000 g/mm$^2$

Surface roughness: 35 micro inch CLA

UTS 370–430 N/mm$^2$

Tin weight: 10–15 g/m$^2$

This steel is used to make cans by blanking a disc, drawing a cup from the disc and if required redrawing the drawn cup to reduced overall diameter and increased height. This steel is also used to produce DWI cans but since finer grain size leads to less surface roughening during drawing, the final thickness of the can body tin coating is more uniform and steel exposure is reduced. In comparison with cans produced from steel as depicted in 1*a* when steel as depicted in 1*b* is used, the same can characteristics re steel exposure can be achieved from a lower plate tin coating. The lower tin weight of 8 grams/m$^2$ is tolerable because little disruptive ironing forces are applied to the tinplate surface. This flow brightened smooth finish (12 micro inch) is satisfactory for deep drawing but a rougher finish will assist lubrication of deeper cups and cans during wall ironing, say 35 microinch CLA, although a lower roughness is preferred for drawn or redrawn cans.

During contraction of the periphery of a blank in a drawing die compressive hoop strains develop to compress the steel so that large grain size steels develop surface toughening called the orange peel effect. The surface roughness of the side wall developed during redrawing is shown in FIG. 2*b*.

Figure 3:
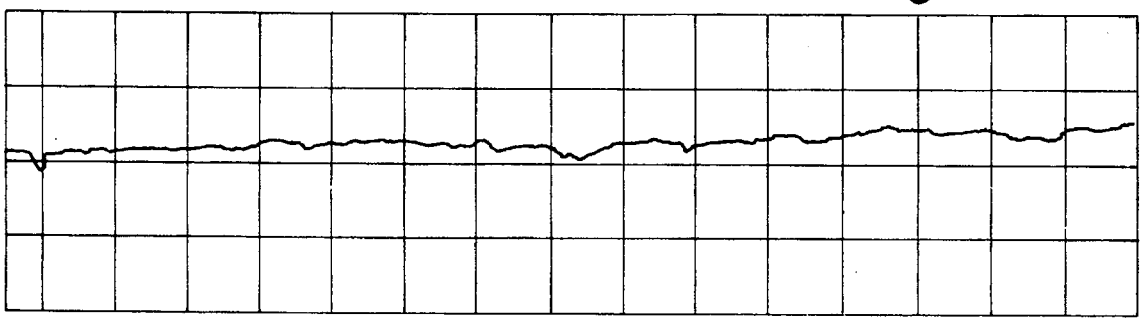
FIG. 3*a* is a surface roughness trace of the fine grain size tinplate of FIG. 1*b;*
FIG. 3*b* is a surface roughness trace of the tinplate of FIG. 1*b* after drawing and redrawing to become the side wall of a can.
FIG. 3*c* is a surface roughness trace of the tinplate of FIG. 3*b* after drawing and redrawing and redrawing through a punch/die gap to achieve a small degree of ironing reduction in thickness.
Figure 3:
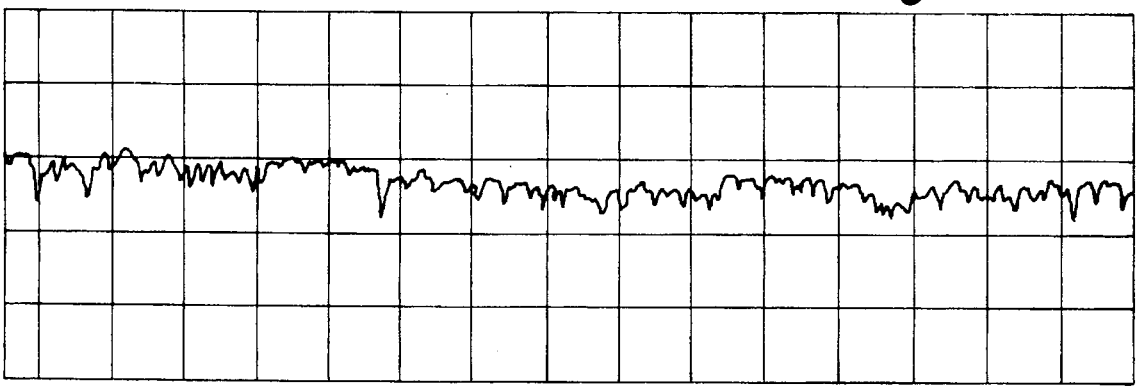
Figure 3:
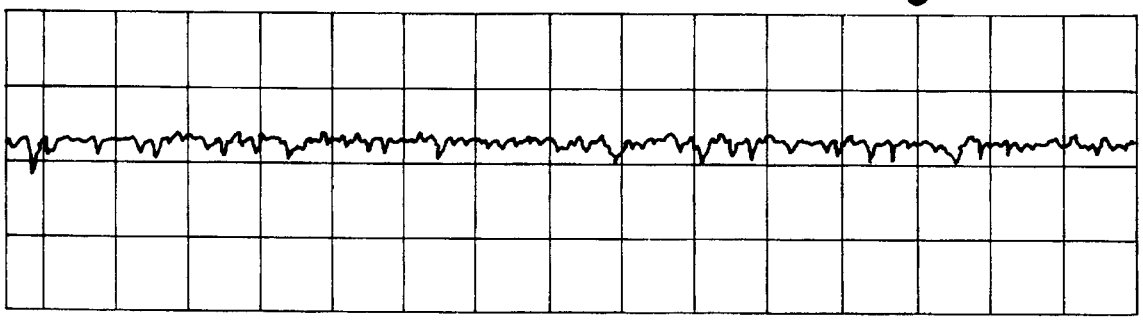

FIG. 3*a* shows the surface of a fine grain size tinplate (eg. 12 micro inch CLA) before drawing or ironing. FIG. 3*b* shows that much less roughening arises during drawing of a cup than arose on FIG. 2*b*. FIG. 3*c* serves to show the flattening effect of wall ironing.

Coatings and lacquers are known which can be applied to tin plate before drawing to cup shaped articles and their adhesion permits manufacture of quite deep cups before the roughening disrupts them but wall ironing puts such coatings at greater risk of disruption.

Lacquer continuity can be improved by use of a steel grain size greater than 4000 grains/mm$^2$ as is discussed in GB 1575204 to which the reader is directed for fuller description.

For our purposes it is concluded that steel behaviour limits the use of preapplied lacquer or coatings to articles which are drawn to cups not exceeding a depth to diameter ratio of 1.5 to 1. For greater depths of cup formed by deep drawing or wall ironing of drawn cups our lacquered side wall margin is best achieved by redrawing or wall ironing the plain tinplate and then applying a suitable lacquer.

(B) SELECTION OF LACQUERS AND COATINGS

If a precoated tinplate blank is to be used it is preferable that the tinplate surface is passivated by immersion in a sodium dichromate solution, before subjection to drawing and redrawing operations. This sort of chromate treatment improves the retention or continuity of lacquer film during the drawing operations.

If the tinplate is to be drawn, redrawn and wall ironed, the presence or absence of a chromate passivation layer is less important because the severe redrawing and wall ironing operations will disturb it. The presence of a chromate passivation layer on the base may slow down take up of tin into product.

Lacquers suitable for application to tinplate before deep drawing include epoxy amino resin varnishes, epoxyesters , and epoxy phenolic lacquers. These lacquers are applied to tinplate sheets by the usual roller coating apparatus and stoved before use. Lacquers and coatings suitable for spraying onto the side wall of drawn redrawn or wall ironed cans include vinyl lacquers, vinyl organosols, epoxy amine which are adjusted to the required viscosity for accurate spraying onto each can: the word "lacquer" indicating generally unpigmented material and the word "coating" indicating pigmented materials.

In a preferred embodiment the necessary firm adherence of the lacquer margin to the tinplate is achieved by an epoxy phenolic lacquer formulation adjusted to the desiredi viscosity and stoved for 2 minutes at 200 °C.

(C) SELECTION OF MANUFACTURING PROCESS

Figure 4A:
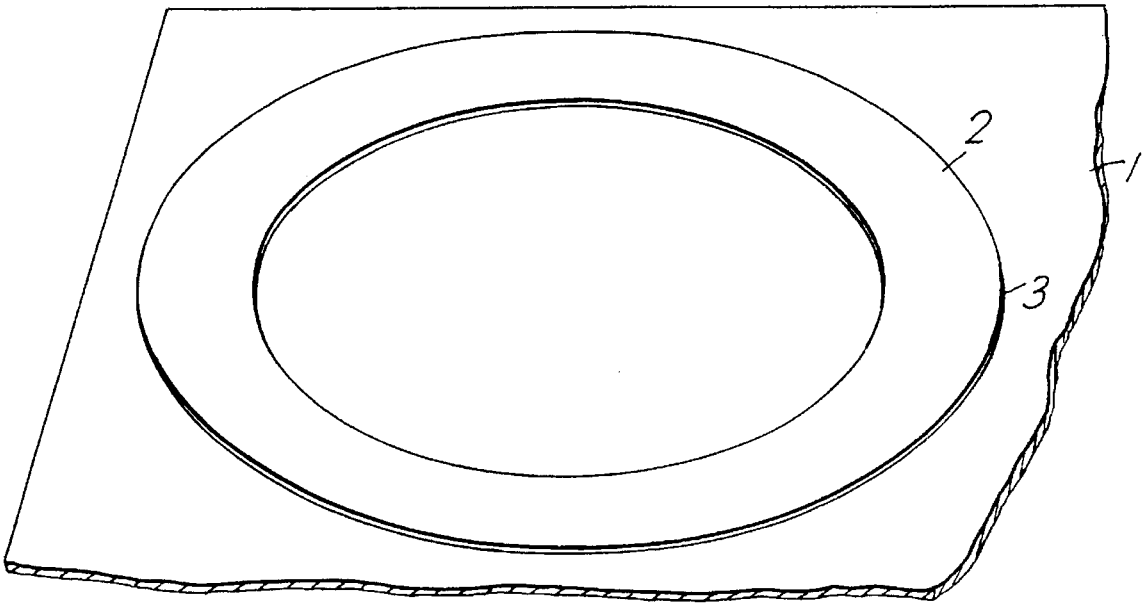
FIG. 4*a–c* is a diagrammatic sketch of the steps of a first method in which a precoated blank is drawn to a shallow can.
Figure 4B:
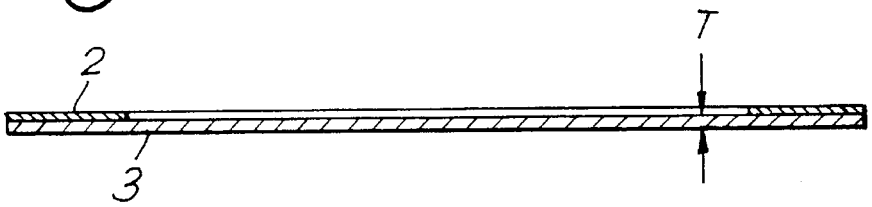
Figure 4C:
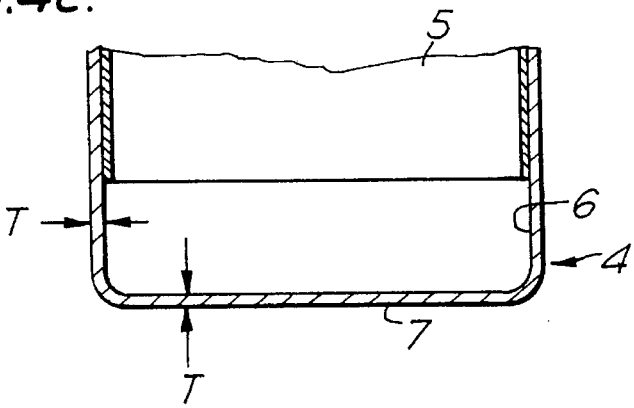

FIG. 4*a* shows a fragment of a sheet of tinplate 1 to which has been applied an annulus of lacquer 2. The periphery of the annulus defines the perimeter of a blank 3 of a size to form the shallow cup shown in FIG. 4*c*. Typically the blank has a thickness T in the range between 0.004" (0.1 mm) and 0.009" (0.22 mm) typically 0.17 mm. This method of forming a can comprises the steps of stencil coating a sheet of tinplate with an array of annulii of lacquer, stoving the tinplate sheets to dry the lacquer, stamping out the blanks of thickness "T" shown in FIG. 4*b* and drawing each blank to a cup 4 such that the annulus of lacquer forms a margin 5 of lacquer on the interior sidewall surface 6 of each cup as can been in FIG. 4*c*. The bottom wall 7 of the tinplate cup is in the as plated condition and a lower, unlacquered, part of the side wall is not significantly different. Both side wall 6 and end wall 7 are substantially of thickness "T", but the side wall surface has been compressed in the hoop direction. Any disturbance of the upper part of the side wall metal, by the act of drawing, is covered by the lacquer margin so that the available tin, presented to a product packed in the cup, is defined by the bare tin surface area presented to the product.

We have observed that the tin on matt tin plates surfaces tends to go into solution in the product more rapidly than does flow brightened tin so for cans made by this method a flow brightened tinplate is preferred. A typical tinplate specification for this shallow drawn can is:

Grain size: 4000 grains/mm$^2$ minimum

Surface roughness: 12 to 25 microinch CLA

Tin weight: greater than 5.6 g/m$^2$

Suitable lacquers include epoxy phenolic lacquers and epoxy based lacquers or coatings.

Figure 5A:
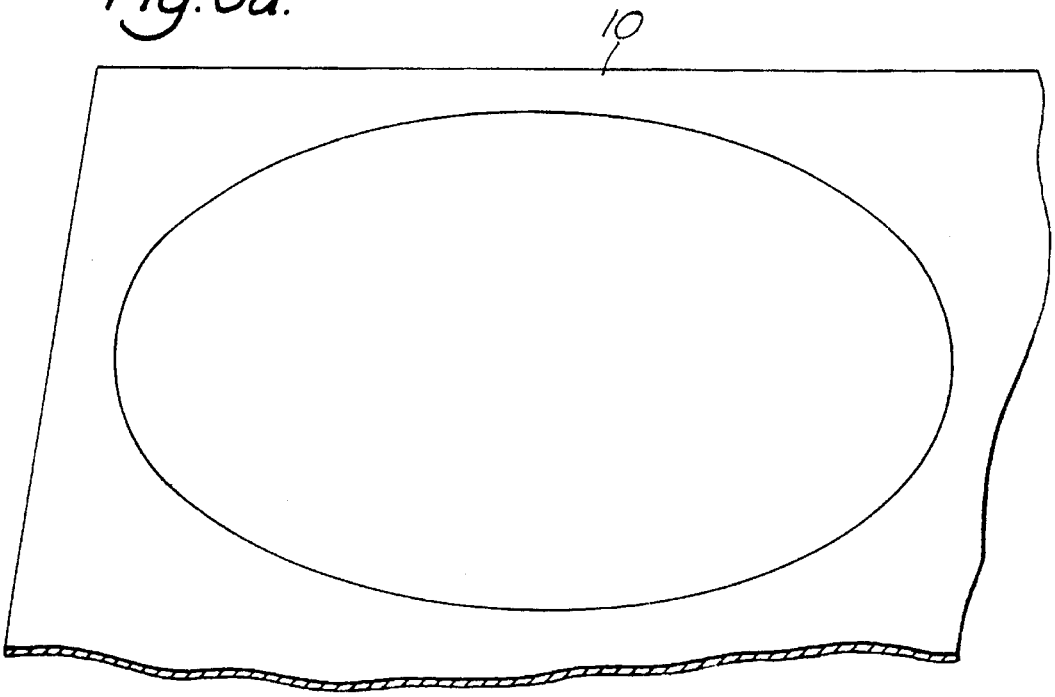
FIG. 5*a–d* is a diagrammatic sketch of the steps of a second method in which a plain tinplate blank is drawn in a first die and redrawn and ironed in a second die.
Figure 5B:
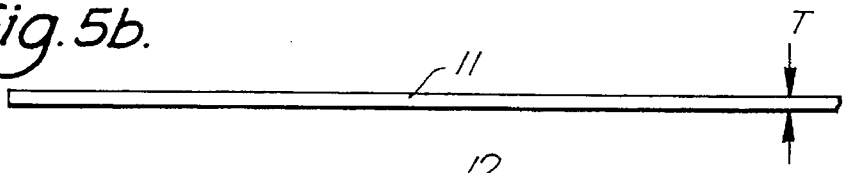

FIG. 5*a* shows a fragment 10 of a sheet of tinplate after blanking out of the circular blank 11 shown in side view in FIG. 5*b*. The blank has a thickness "T" typically in a range 0,004" to 0,009" (0.10 mm to 0.22 mm). The blank is drawn to a cup 12 shown in FIG. 5*c* to have a side wall 13 of thickness "T" substantially equal to the thickness of the blank and to the thickness of the end wall 14.

Figure 5C:
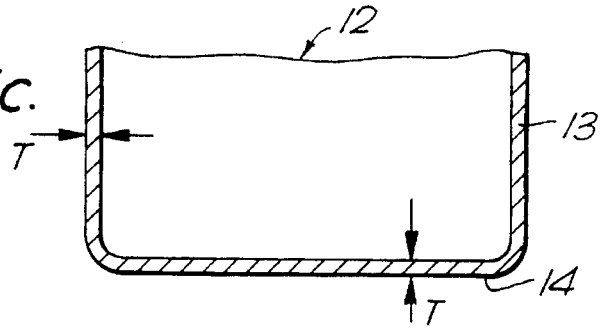
Figure 5D:
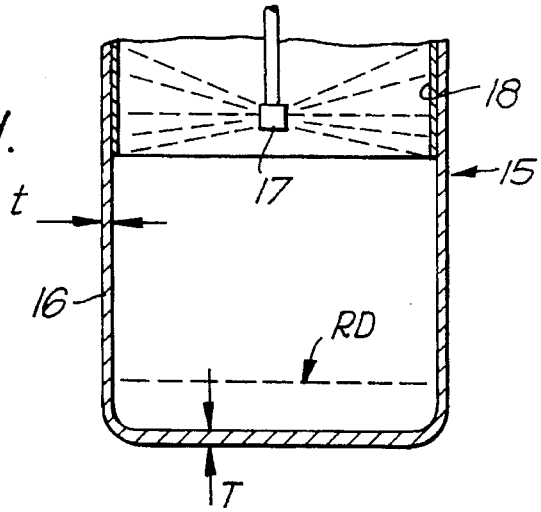

The taller cup/can 15 shown in FIG. 5*d* has been redrawn by pushing, with a punch, the cup of FIG. 5*c* through a die that makes with the punch a clearance less than the metal thickness "T" so that the cup of FIG. 5*c* has been reduced in overall diameter increased in height, and reduced in thickness of sidewall 16 to a thickness "t", typically between 0.0035" and 0.008" (0.09 mm to 0.20 mm). This redrawing process in which the wall thickness is only slightly reduced, is sometimes called "partial wall ironing" (PWI) because only a modest per cent reduction of wall thickness is imposed.

The dashed line "RD" indicates the shortage in height of cup that would have been achieved by redrawing with a punch/die clearance greater that T so the height advantage of about 10% available by a reduction in wall thickness of about 10% would not be achieved. However, this ironing force does abrade the tin surface of the side wall. FIG. 2*c* shows the surface finish of the side wall of the can of FIG. 5*d*. It will be noticed that the roughness peaks of the internal surface of the can are flat topped which indicates that some of the tin layer has been moved into the troughs and steel exposure is a serious risk, particularly towards the top of the can.

In order to repair this surface damage a lacquer is sprayed from a nozzle 17 to cover the more severely worked upper margin of the side wall. The axial extent of the lacquer margin 18 is chosen to control the area of tin exposed on the interior of the rest of the side wall and the bottom wall and also to protect the worked surface of the side wall.

A feature of the partial wall ironing process is that a smaller blank diameter is needed than would be required in a draw/redraw process to achieve the same height of can but the PWI side wall will suffer more cold work giving a risk of electrode potential difference between end wall and side wall.

A typical tin plate specification for these partially wall ironed cans is:

Grain size: greater than 400 grains/mm$^2$

Surface roughness: 12 to 25 microinch CLA

Tin weight: greater than 5.6 g/m$^2$

Suitable spray lacquers include epoxy phenolic or epoxy amino lacquers which are formulated to a suitable viscosity and applied by spraying onto the can interior. The cans are then stoved for 2 minutes at 200° C.

Figure 6A:
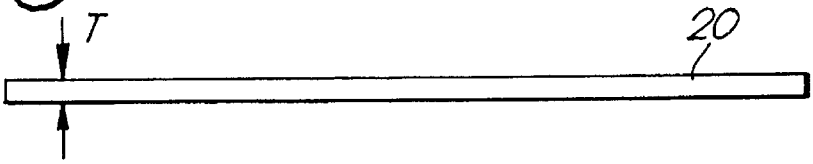
FIG. 6*a–d* is a diagrammatic sketch of the steps of a third method in which a plain tinplate blank is drawn in a first die, redrawn in a second die, and then subjected to severe multiple wall ironing.

FIG. 6*a* shows a tinplate blank 20 of diameter approximately 6 inches (150 mm) of thickness T (0,012"; 0,305 mm) which is drawn, redrawn and wall ironed by reduction of 57 % to make a can body 73 mm diameter by 110 mm tall.

Figure 6B:
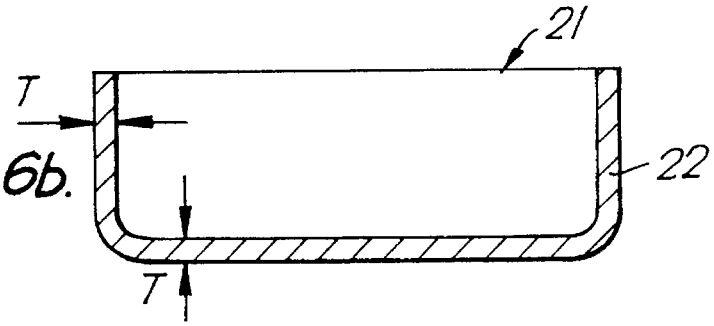

FIG. 6*b* shows a cup 21 that is drawn from the blank in a first press tool to a diameter 100 mm by a height of approximately 30 mm, while maintaining the side wall 22 substantially at a thickness T equal to that of the blank and bottom of the cup.

Figure 6C:
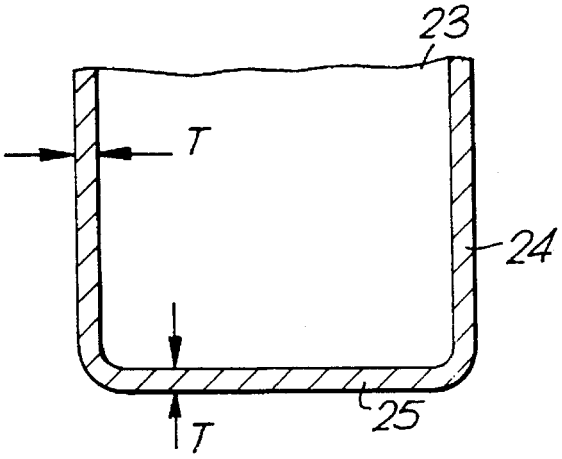

FIG. 6*c* shows a redrawn cup 23 formed in a second press tool to a diameter 73 mm by about 50 mm tall sidewall 24 while maintaining the side wall thickness T substantially equal to the thickness of the bottom wall 25.

The redrawn cup of FIG. 6*c* is pushed by a punch through a series of two wall ironing rings to make a can 26. Each ring makes with the punch, a clearance less than the redrawn cup side wall thickness T. Typically side wall reductions are: At the first ring 35%, at the second ring 33% to make a total reduction of 57%. As can best be seen in FIG. 7, the ironed side wall 27, of thickness "t", is about half the original blank thickness T, ie. 0,005" (0.13 mm): therefore the ironed side wall 27 is about 117 mm tall to allow for trimming to final height.

At the end of the stroke, a profiled end of the wall ironing punch cooperates with a profiled bottom tool to shape a flat central panel 28 and annular expansion rings 29 in the bottom wall of the wall ironed can body.

Figure 6D:
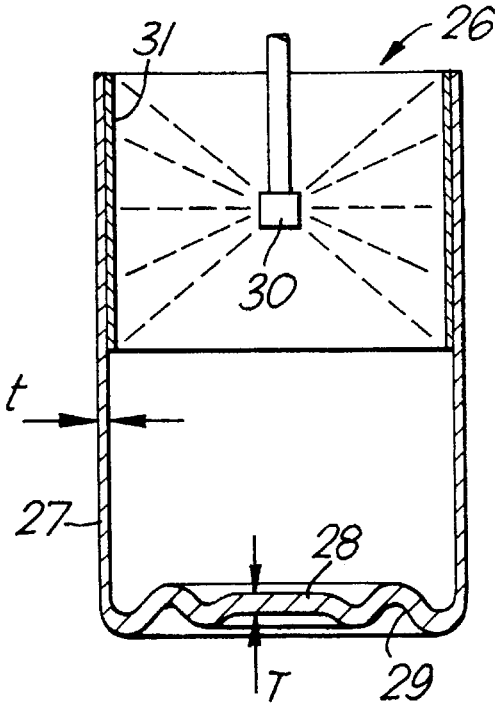

In FIG. 6*d* a nozzle 30 is shown during spraying of a lacquer onto the interior surface of wall ironed can which is rotated to progressively present the side wall to the spray. The deposit of lacquer 31 is confined to a margin extending from the rim of the can to about half way down the side wall. The axial extent of the lacquer margin was chosen in view of tin pickup in products packed and stored with various lengths of lacquer margin we tried, as will be discussed later.

Accurate location of the margin is achieved by use of appropriate viscosity of the lacquer sprayed and choice of lacquer such as epoxy phenolic lacquers. After spraying, the cans are stoved to dry the lacquer. Typical stoving is at 200° C. for 2 minutes.

Figure 7:
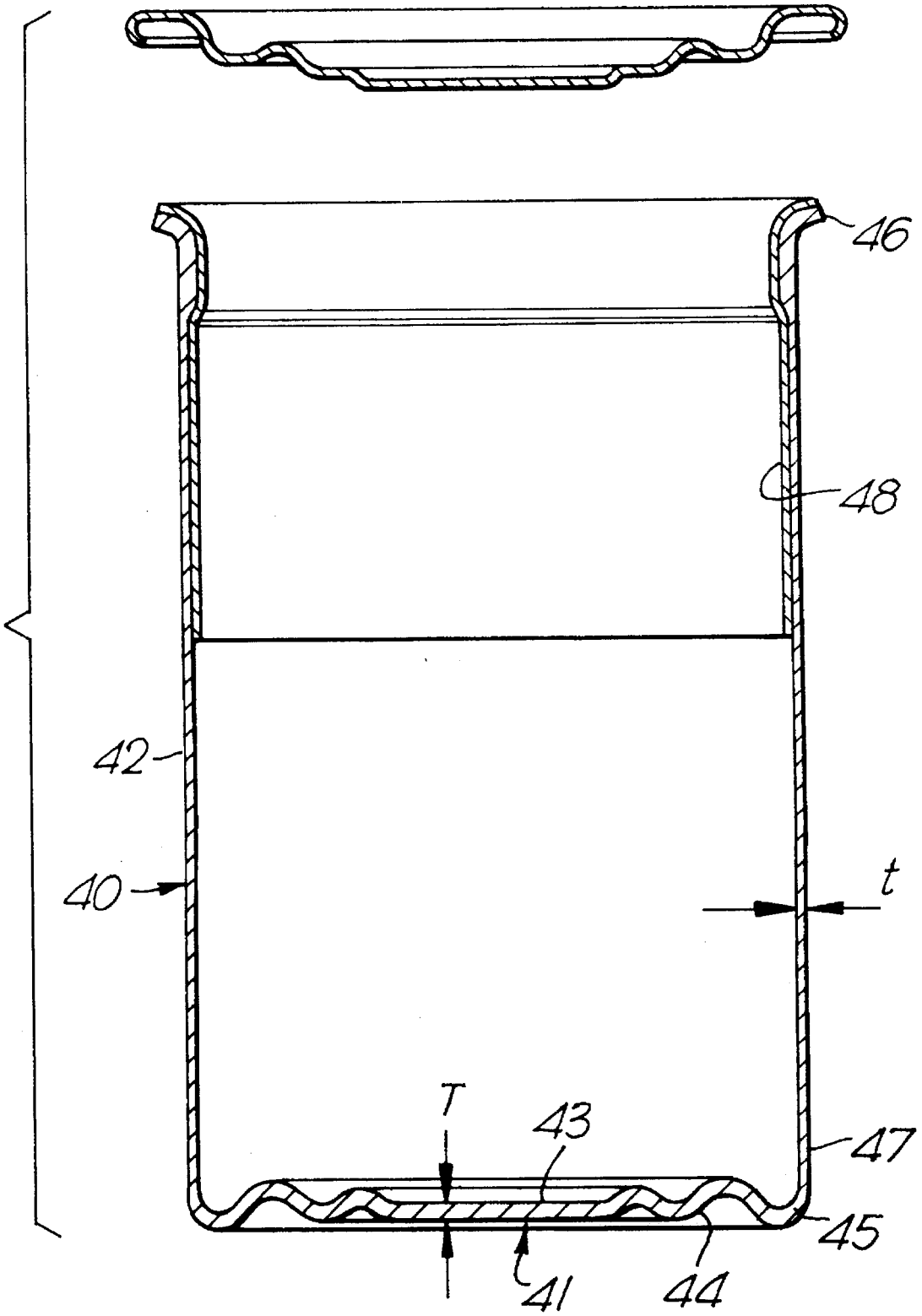
FIG. 7 is a sectioned side view of the can made by the steps shown in FIG. 6.

FIGS. 6*a* to 6*d* are diagrammatic and presented to illustrate the steps in this drawing, redrawing and wall ironing and spraying method. FIG. 7 shows a life size cross section of the 73 mm diameter×110 mm tall can used for storage tests with a variety of products.

In FIG. 7 the can 40 comprises a bottom wall 41 of thickness T and a side wall 42 of lesser thickness t upstanding from the periphery of the bottom wall. The bottom wall comprises a flat central panel 43, concentric annular expansion beads 44 surrounding the central panel, and a stand bead 45 surrounding the expansion beads. The side wall 42 extends upwardly from the bottom wall to an outwardly directed flange 46 which defines the mouth of the can body. The flange and a short length of side wall is thicker than the rest of the side wall in order to better facilitate double seaming of a can end shown above the can.

The thicker metal T of the can bottom blends into the thinner metal of the side wall thickness t in a short tapered annulus 47 of side wall material.

In FIG. 7 the lacquer margin 48 on the interior surface of the can extends from the flange for half the length of the side wall so covering the most severely deformed metal of the side wall.

The rest of the interior surface of the side wall presents, to a product packed in the can body, a surface somewhat smoothed by ironing (See FIG. 2*c*) which may have an electro potential somewhat different from the less severely worked tin coating on the interior of the bottom wall.

The tinplate specification for this can is:

Flow brightened D 15/2.8, the heavier tin coating E 15 to be on the inside of the can Grain size in excess of 20,000

Surface roughness: 35 microinch CLA

UTS: 370–430 N/mm$^2$

The lacquer specification was an epoxy phenolic lacquer and the stoving program was 200° C. for 2 minutes.

The advantages of using this drawn and wall ironed can for packing foods are:

a) a seamless can body is achieved from a relatively small area of tinplate blank.

b) the margin of lacquer applied to the side wall not only protects the most severely worked areas of the side wall but also serves to control the area of tinplate presented to the product.

c) the controlled area of tin presented to the product can ensure that the ultimate amount of tin taken up by the product is limited to a chosen value.

(D) PACK TESTS

Can bodies of the shape shown in FIG. 7 were drawn and wall ironed from a matt tinplate. Further can bodies of the shape shown in FIG. 7 were drawn from flow brightened tinplate.

Control can bodies were made from flow brightened tinplate to comprise a cylindrical side wall having a side seam, and a can end attached to the side wall by a double seam.

A quantity of each sort of body was packed with a product and each can was closed by a can end by double seaming. All the cans were subjected to the usual thermal process appropriate to the product.

Some of the cans of each sort were stored at ambient temperature and others were stored at 37° C.

First test cans were opened after about one month, second test cans were opened after about 3 months and third test cans were opened after about six months. In each test the tin content of the product in the can was measured. The "3 piece" side seamed cans have been used for many years in the trade and represent a behaviour known to be satisfactory, so that in the graphs which follow, the behaviour of the wall ironed cans is Compared with the behaviour of the can used in the trade, namely the flow brightened "3 piece" cans.

FIG. 8*a* shows graphs of actual tin pickup against time in weeks derived from examination of pasta in tomato sauce after storage in the wall ironed and "3 piece" control cans at ambient temperature. The test cans were drawn and wall ironed from a temper 2 (T2) batch annealed (BA) tinplate having a matt electrolytically deposited tin coating of 13.8 g/m$^2$ and a surface roughness of 35 microinches CLA (35M). The test cans and lacquered control cans were all closed with lacquered can ends. FIGS. 8*a*, 8*b*, 9*a* and 9*b* show pick up from the body and one end of each control can, but pickup from side wall and integral base of the test cans.

At the right of each graph in FIG. 8*a*, a figure denotes the height of bare tin surface between the bottom of the lacquer margin and the integral can bottom. For example, the uppermost graph marked 7 relates to an unlacquered wall length of 70 mm which, on these 110 mm tall cans, implies a lacquer margin extending 40 mm from the mouth of the can, down the interior surface of the side wall.

The graph denoted "C" relates to tin picked up from the interior surface of the control cans having a cylindrical body closed at both ends by a can end attached to the body by a double seam. It will be noticed that the tin pickup shown in graphs 7 and C are satisfactorily similar.

The graphs marked 4 and 2½, indicating bare side wall margins of 40 mm and 25 mm height, serve to show that greater heights of lacquer margin do indeed reduce the amount of tin available for pickup.

The graph denoted FL shows that a complete lacquer coating in the interior surface of the can substantially prevents pickup of tin.

In FIG. 8*b* shows that the pickup of iron from the wall ironed tinplate remained insignificant for the graphs denoted 4, 2½ and the control cans "C". However, the graph 7 shows a surprising increase in iron pickup after 45 weeks. This rise in iron content in the pasta is believed to have been due to exposure of damage to the tin coating, arising at the more severely ironed side wall material. It is interesting to note that the fully lacquered cans also give rise to pickup of iron.

From FIGS. 8*a* and 8*b* we conclude that a) A margin of lacquer does limit the amount of tin available.

b) The bare tinplate of the side wall must not be overworked particularly in the upper part of the sidewall.

After wall ironing, it is usual to wash the cans to remove press tool lubricant from the surfaces of the cans. The washing apparatus is sometimes used to apply a chromate treatment to the cans to repassivate the tin layer.

FIG. 9*a* shows results of actual tin pickup with time at ambient storage temperature for wall ironed cans made from the same tinplate as used to arrive at the graphs of FIG. 8*a* except that some of the cans tests had been subjected to the chromate treatment and some had not. All the test cans had a 40 mm bare annulus of tin on the side wall, the rest of the side wall being lacquered.

In FIG. 9*a* the cans subjected to chromate treatment gave rise to graph CR; the cans without chromate treatment gave rise to graph NCR. It will be noticed that the non-chromated cans gave rise to greater tin pickup during the first sixty weeks of storage. This observation suggests that a non-chromated tin surface is marginally advantagous in giving a preservative effect earlier in the storage period.

FIG. 9*b* shows actual iron pickup against time for the same sort of cans as were used to obtain FIG. 9*a*. In FIG. 9*b* the graph denoted NCR shows that the cans which had not had a chromate wash gave rise to a substantially steady and quite limited iron pickup for the whole storage period of 110 weeks. In contrast the graph denoted CR shows that after about 45 weeks the cans which had been chromate washed gave rise to a sudden and seriously increased rate of iron pickup.

From FIGS. 9*a* and 9*b* we conclude that, for this pasta/tomato sauce product it is preferable to use cans that have not been subjected to a chromate wash treatment.

FIG. 10*a* shows graphs of actual tin pickup plotted against storage period for wall ironed cans made from matt tinplate, and wall ironed cans made from a flow brightened tinplate, both having a 60 mm lacquer margin. 3-piece control cans and fully lacquered DWI cans were used for comparison. All the cans were packed with spaghetti hoops in tomato sauce, closed with lacquered can ends and some stored at ambient temperature, and others at 37° C.

In FIG. 10*a* it is apparent from graph M that the wall ironed cans made from matt tinplate gave higher initial values of tin pickup at the end of one month than did the cans drawn and ironed from a flow brightened tinplate, see graph FB. After one month of storage graphs M and FB indicate that the difference in tin pickup is substantially maintained. Graph C shows that the "3-piece" control cans gave tin pickup values between those of the matt and flow brightened cans. The lacquered cans did not release tin significantly.

FIG. 10*b* was obtained using the same sort of cans and spaghetti product as used to obtain FIG. 10*a*, and the pickup of tin is plotted against the storage period, at 37° C. FIG. 10*b* graph M shows that the wall ironed cans made from matt tinplate give rise to consistently higher values of tin pickup throughout the storage period but these tin pickup values are not significantly different from values of tin pickup from the control cans at 12 weeks and 24 weeks tests. The tin pickup from wall ironed cans made from flow brightened tinplate was substantially the same as pickup from the control cans after the 12 weeks of storage so use of a flow brightened tinplate may be preferred for this product. From these results we conclude that matt tinplates give rise to more rapid tin pickup than the flow brightened control cans, which in turn give more rapid tin pickup than the flow brightened wall ironed cans: and benefit must be judged against risk of iron pickup.

FIG. 11*a* shows graphs of actual tin pickup against storage period for wall ironed cans made from temper 4 (T4) continuously annealed (CA) steel in the 35 microinch CLA roughness some of which were made of matt tin plate and some of which were made from flow brightened tinplate. Both these variants were of tin weight 12 g/m$^2$. A lacquer margin 60 mm high was applied to the upper part of the interior of the side wall as shown in FIG. 7. The ironed cans, and 3-piece control cans having plain interiors, were packed with baked beans in a tomato sauce and closed with plain can ends.

In FIG. 11*a*, graph M shows that the cans produced from matt tinplate gave marginally higher tin pickup than the control cans which gave consistently higher tin pickup than the cans made from flow brightened tin plate. The substantially lower tin pickup values in FIG. 11*a* than in FIG. 10*a* can be explained by the fact that the baked bean product was less aggressive than the spaghetti pack but the relative performance of the ironed matt tinplate surfaces, ironed flow brightened tinplate surfaces and unworked tinplate of the control cans remains similar.

However FIG. 11*b*, obtained from iron pickup tests on the same sort of cans as used to obtain FIG. 11*a*, shows that the less aggressive baked bean product gave rise to little iron pickup in all the cans tested.

FIG. 12 is a graph showing iron exposure arising at various % ironing reductions on a differential tinplate of tin weight D 2.24/3.36. The iron exposure was measured on the interior surface of the ironed cans that had the initial 2.24 g/m$^2$ coating of tin. Whilst this graph is based on initial tin coatings that are thinner than we expect to use to achieve useful tin pickup, they serve to show that the iron exposure is proportional to the degree of wall ironing reduction. Our lacquer margin is applied to the margin of ironed side wall nearest the mouth of the can and so minimise iron pickup at the most vulnerable part of a drawn and ironed can.

From purely geometric considerations the following formulae show the relationship between:

T the tincoating in grams/m$^2$ of the as-received tinplate;

I the ironing reduction employed ( % );

V the weight in grams of product in the can whose diameter is 2 R;

H is the extent (height in mm) of the base tin margin and C is the chosen level in ppm of tin pickup.

Useful forms of the equation $$H = \frac{1}{2}\left\{ \frac{CV}{\pi RT(1 - I/100)} - R \right\}$$

$$T = \frac{CV}{\pi R(2H + R)(1 - I/100)} \text{ grams/m}^2$$

$$C = \frac{\pi R(2H + R)(1 - I/100)}{V} \text{ ppm}$$

The relationship assumes that the shelf life of the can is governed by the thickness of tin coating on the exposed area of the can body side wall.

Consequences of selecting a maximum tin pickup in the product are:

(a) the product will be protected by pickup of the chosen amount of tin but, once taken up further protection ceases, (b) when all the tin provided has been picked up by the product there is a risk that exposure of iron to the product will be followed by corrosion of the iron substrate of the tinplate and evolution of gas in the can (eg. hydrogen swelling).

Therefore, the useful life of the can is governed by the time to removal of the selected amount of tin.

Figure 13:
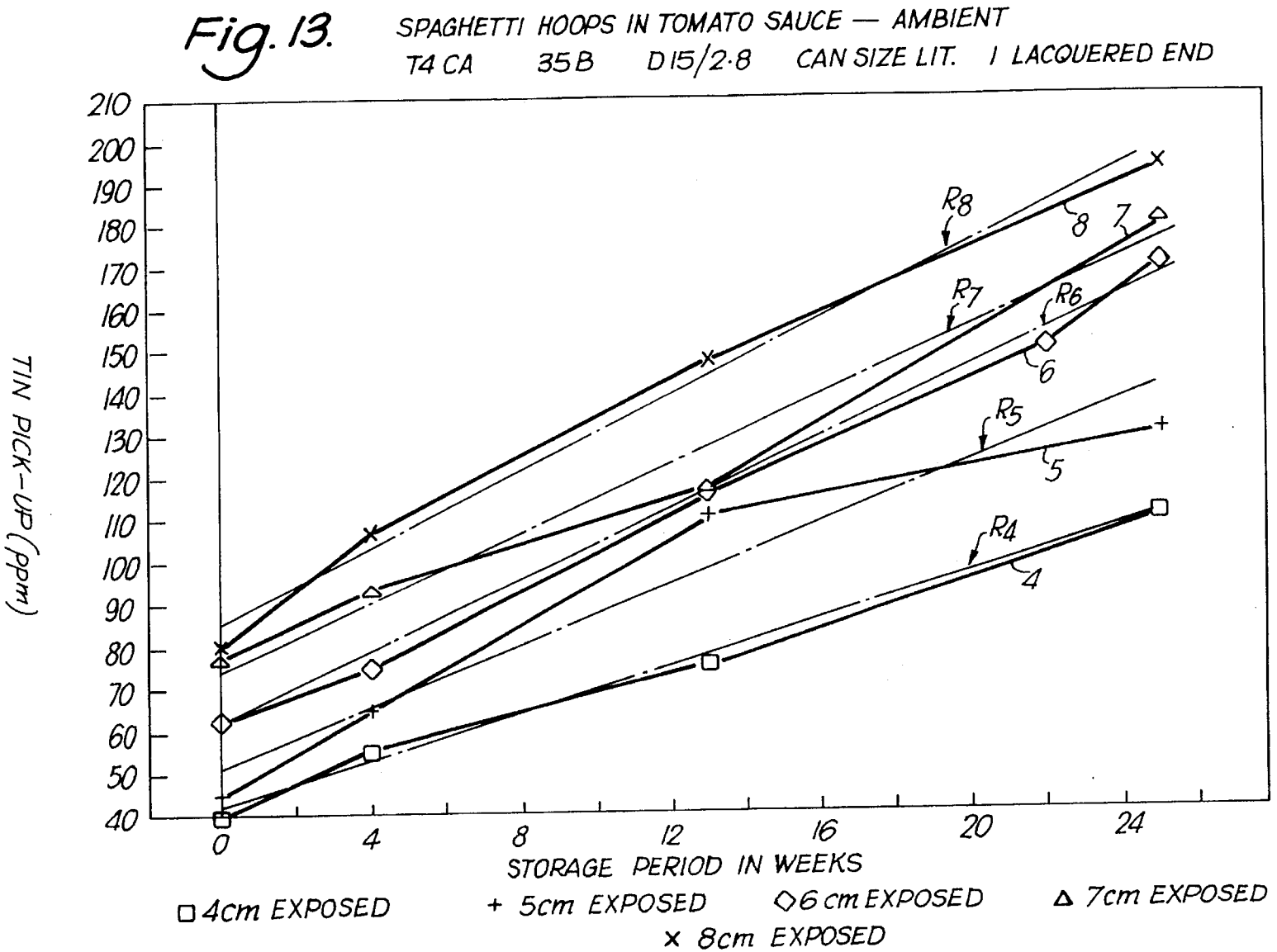
FIG. 13 is a graph of actual tin content in spagetti hoops in tomato sauce plotted against time to indicate rate of tin pickup.

By way of example, FIG. 13 shows graphically the amount of tin picked up by spaghetti hoops in tomato sauce over a period of 24 weeks from "UT" cans 73 mm diameter by 115 mm tall made by drawing and a 57% wall ironing reduction, similar to that shown in FIG. 7 but having a range of heights H of bare tin on the interior of the side wall. These cans were made from temper 4 continuously annealed, differentially coated tinplate with a 15 g/m$^2$ coating inside and 2.8 g/m$^2$ outside. The cans were closed with lacquered can ends.

In FIG. 13, it can be seen that the actual tin pickup graph, denoted 4, 5, 6, 7, 8 corresponding to heights H (shown in heavy lines) approximate to straight lines, denoted R4, R5, R6, R7, R8 (shown dashed) which permit reading off at the left of the graphs at zero time a tin pickup value for the amount of tin taken up during thermal processing at the packing factory. Measurement of the slope R of each straight line R4 etc gives a gradient indicative of rate of tin pickup in the product. So a simplified, but useful, prediction of time to removal of all the tin exposed on the side wall, or reaching of a chosen limit can be calculated from an equation:

$$T=k+Rt$$

where T is tin pickup

K is the amount of tin picked up (ppm) during thermal processing; and t is the storage time in weeks Table 1 was prepared using the data of FIG. 13 and the above equation. Having regard for the fact that varying wall ironing reductions will vary the amount of tin on the side wall, or a range of tin coatings may be chosen, values of tin weight 5.76 g/m$^2$, 6.11 g/m$^2$ and 6.36 g/m$^2$ are tabulated to show the effect of original side wall tin weight before filling and processing of the product.

Assuming a maximum tin pickup value of 200 ppm is chosen, table 1 shows that the cans having a bare tin margin 40 mm tall will deliver 181 ppm in 51 weeks, so there is risk of premature iron pickup if the side wall tin coating is 5.76 g/m$^2$ or less after this period of time. However, if the side wall has a 6.36 g/m$^2$ tin coating these cans having a 40 mm bare tin margin will take 58 weeks to deliver 200 ppm of tin into the product.

In contrast the table also shows that this arbitary limit of 200 ppm pickup of tin can be substantially achieved with a 80 mm bare margin of tin in 26 weeks, but the time to complete removal of tin on the side wall will still be 50 weeks but by which time the tin picked up will be over 300 ppm.

From the forgoing it will be understood that the tin coating weight in the body side wall and the height of the base tin margin are chosen to satisfy shelf life and tin pickup requirements.

TABLE 1

Prediction to time of tin removal and iron pickup in product

| HEIGHT OF EXPOSED TIN ON SIDE WALL (mm) | TIN PICKUP EQUATION - T = K + Rt | TIME TO REACH A 200 ppm LIMIT OF TIN IN PRODUCT (WKS) | TIN IN PRODUCT (ppm) AT PREDICTED TIME IN WEEKS TO START OF IRON PICKUP IN WEEKS | | |
|---|---|---|---|---|---|
| 40 | 41.4 + 2.72 (wks) | 58 | 181 ppm<br>51 | 192 ppm<br>55 | 200 ppm<br>58 |
| 50 | 51.5 + 3.43 (wks) | 43 | 204 ppm<br>45 | 217 ppm<br>48 | 225 ppm<br>51 |
| 60 | 60.1 + 4.25 (wks) | 33 | 241 ppm<br>43 | 255 ppm<br>46 | 266 ppm<br>49 |
| 70 | 74.7 + 4.02 (wks) | 31 | 271 ppm<br>49 | 288 ppm<br>53 | 299 ppm<br>56 |
| 80 | 85.1 + 4.43 (wks) | 26 | 308 ppm<br>50 | 326 ppm<br>54 | 340 ppm<br>58 |
| | ORIGINAL SIDE WALL TIN AVERAGE TIME (wks) TO DETINNING OF SIDE WALL | | 5.76 g/m$^2$<br>48 | 6.11 g/m$^2$<br>51 | 6.36 g/m$^2$<br>54 |

We claim:

1. A can body drawn from a tinplate to comprise an end wall and an integral side wall which extends from the periphery of the end wall to a terminal portion defining a mouth of the body, characterized in that, a margin of organic coating material extends from the terminal portion along the interior surface of the side wall for an axial distance less than the length of the side wall, and the rest of the side wall has an exposed tin surface.

2. A can body according to claim 1 wherein the organic coating material is chosen from a group consisting of epoxy phenolic lacquer, epoxy amine lacquer, acrylic resin lacquer, epoxy polyester lacquer, and vinyl lacquer, with or without a pigment.

3. A can body according to claim 2 wherein the tinplate has a grain size finer than 3000 grains/mm$^2$.

4. A can body according to claim 1 wherein the tinplate has a grain size finer than 3000 grains/mm$^2$.

5. A can body according to claim 4 wherein the tinplate has a surface roughness between 12 microinches CLA and 25 microinches CLA.

6. A can body according to claim 5 wherein the tinplate has a tin weight between 3 grams per square metre and 10 grams per square metre.

7. A can body according to claim 6 wherein the tinplate is a differentially coated tinplate and the heavier tin coating is on the interior surface of the can body.

8. A can body according to claim 7 wherein the differential tinplate is D 15/2.8, the 15 gram/mm$^2$ heavier tin coating being on the interior surface of the can.

9. A can body according to claim 1 wherein the side wall has been passed through at least two drawing dies, and the tinplate from which the can was drawn had a grain size finer than 4000 grains/mm$^2$, a surface roughness between 12 and 25 microinches CLA, and an initial tin weight greater than 5.6 gram/mm$^2$ that becomes the interior surface of the can body.

10. A can body according to claim 1 wherein the organic coating is chosen from epoxy phenolic lacquer or epoxy based lacquer.

11. A can body according to claim 1 wherein the side wall has been passed through at least two drawing dies and at least one wall ironing die so that the side wall is thinner than the end wall, and the tinplate from which the can was drawn had a grain size finer than 20,000 grains/mm$^2$.

12. A can body according to claim 11 wherein the organic coating is an epoxy phenolic lacquer.

13. A can body according to claim 1 wherein the extent (H) of the base tin, as measured from the end wall to a lacquer margin along the sidewall, is expressed by the formula:

$$H=\frac{1}{2}\left\{\frac{CV}{\pi RT(1-I/100)}-R\right\}$$

where R is the radius of the side wall in mm

V is the weight of product in the can in gm

T is the weight of the tin coating in g/m$^2$

I is the % ironing reduction

C is the chosen level of tin pickup limit in ppm.

14. A can body according to claim 1 wherein the margin of the organic coating material ends a substantial distance short of the end wall periphery.

15. A method of making a can body from tinplate by the steps of:

(a) providing a tinplate cup having an end and wall and an integral side wall extending from a periphery of the end wall to a terminal portion defining a mouth of the can body, characterized in that, (b) an organic coating is applied to a margin of the interior surface of the side wall extending from the terminal portion along an interior surface of the side wall for a distance less than the length of the side wall with the remainder of the side wall and the end wall having exposed tinplate surface.

* * * * *